US009249652B2

(12) United States Patent
Montgomery

(10) Patent No.: US 9,249,652 B2
(45) Date of Patent: Feb. 2, 2016

(54) CONTROLLED FRACTURE INITIATION STRESS PACKER

(75) Inventor: Carl T. Montgomery, Grove, OK (US)

(73) Assignee: ConocoPhillips Company, Houston, TX (US)

( * ) Notice: Subject to any disclaimer, the term of this patent is extended or adjusted under 35 U.S.C. 154(b) by 536 days.

(21) Appl. No.: 12/818,995

(22) Filed: Jun. 18, 2010

(65) Prior Publication Data

US 2011/0139456 A1 Jun. 16, 2011

Related U.S. Application Data

(60) Provisional application No. 61/226,836, filed on Jul. 20, 2009.

(51) Int. Cl.
*E21B 43/26* (2006.01)
*E21B 33/127* (2006.01)

(52) U.S. Cl.
CPC ..... *E21B 43/26* (2013.01); *E21B 33/127* (2013.01)

(58) Field of Classification Search
CPC ..... E21B 43/26; E21B 43/267; E21B 23/06; E21B 33/127; E21B 33/1295
USPC ..... 166/308.1, 387, 121, 177.5
See application file for complete search history.

(56) References Cited

U.S. PATENT DOCUMENTS

| | | | | |
|---|---|---|---|---|
| 3,437,142 | A * | 4/1969 | Conover | 166/277 |
| 3,743,017 | A * | 7/1973 | Fast et al. | 166/249 |
| 5,295,393 | A | 3/1994 | Thiercelin | |
| 7,066,265 | B2 * | 6/2006 | Surjaatmadja | 166/308.1 |
| 7,748,460 | B2 * | 7/2010 | Themig et al. | 166/317 |

OTHER PUBLICATIONS

For the American Heritage Dictionary definition: toward. (n. d.) The American Heritage® Dictionary of the English Language, Fourth Edition. (2003). Retrieved Jan. 7, 2013 from http://www.thefreedictionary.com/toward.*

For the American Heritage Dictionary definition: swell. (n. d.) The American Heritage® Dictionary of the English Language, Fourth Edition. (2003). Retrieved Jan. 7, 2013 from http://www.thefreedictionary.com/swell.*

SPE 123589 "Horizontal, Near-Wellbore Stress Effects on Fracture Initiation", Russell Roundtree and Mike Eberhard, Halliburton and Robert Barree, Barree & Associates, 2009 SPE Rocky Mountain Petroleum Technology Conference, Denver, Colorado USA, Apr. 14-16, 2009, pp. 1-17.

* cited by examiner

*Primary Examiner* — Shane Bomar
*Assistant Examiner* — Wei Wang
(74) *Attorney, Agent, or Firm* — ConocoPhillips Company

(57) ABSTRACT

A method for selective placement, initiation and propagation of a hydraulically induced fracture in an open wellbore.

10 Claims, 3 Drawing Sheets

CONTROLLED FRACTURE INITIATION STRESS PACKER

CROSS-REFERENCE TO RELATED APPLICATIONS

This application claims priority benefit under 35 U.S.C. Section 119(e) to U.S. Provisional Patent Ser. No. 61/226,836 filed on Jul. 20, 2009 the entire disclosure of which is incorporated herein by reference.

FIELD OF THE INVENTION

The present invention relates to a method for selectively fracturing a wellbore, particularly, a method for selective placement, initiation and propagation of a hydraulically induced fracture in an open wellbore.

BACKGROUND OF THE INVENTION

An oil or gas well relies on the inflow of hydrocarbon petroleum products. Horizontal well completions are a routine economic exploitation technique in certain formations for increased hydrocarbon inflow. The ability to steer while drilling allows operators to drill theses wells from the surface, instead of sending mining crews downhole. When drilling an oil or gas well, an operator may decide to leave productive intervals uncased (open hole) to expose porosity and permit unrestricted wellbore inflow of hydrocarbon petroleum products. Non-cemented horizontal well completions includes true open hole completions, slotted or perforated-liner completions, or liner completions with external casing packers. Cased and cemented completions can also be used on horizontal wells, which are perforated to permit inflow through the openings created. Reservoir rock properties and the owner/operator's initial investment influence the appropriate completion selection. Generally, most horizontal wells in competent formations receive open hole completions.

Often, wells drilled and completed in low-permeability formations sustain formation damage, thereby limiting productivity. For increased productivity and improved economics, these wells must be stimulated with pumping stimulation fluids, such as fracturing fluids, acid, cleaning chemicals and/or proppant laden fluids to improve wellbore inflow.

The hydraulic fracturing technique creates a fracture extending from a borehole into rock formation in an effort to increase or restore the rate in which fluids can be produced from the formation surrounding the borehole. When applied to the stimulation of oil and gas wells, the objective of hydraulic fracturing is to increase the amount of exposure a well has to the surrounding formation and to provide a conductive channel through which the fluid can flow easily to the well.

In hydraulic fracturing, pressurized fluid fractures the formation. Fluid pressure in the wellbore is increased until it exceeds the formations breakdown pressure, creating one or more fractures at the wellbore. This pressure is commonly known as the fracture initiation pressure. After the well is fractured, the pressure necessary for the fracture to grow, the fracture extension pressure, is generally less than the fracture initiation pressure.

In formations with sufficient vertical permeability, fracturing is unnecessary. Because they are economical, uncased horizontal completions have become commonplace. However, if these wells need to be stimulated, excessive flow rates are often required to fracture these wells because the extremely large wall surface of the wellbore allows fluid to leak off into the formation. Furthermore, when a fracture initiates, stored energy (pressure) will force fluid into the fracture causing unwanted propagation. This problem might also be encountered as a result of excessively high pumping rates, where control of the pressure development might be less accurate.

An industry solution includes static diversion techniques that typically use mechanical systems to divert fluid flow into a short section of the formation. One such device, known as the straddle-packer systems, uses two hydraulically activated packers located a few feet apart. Fracturing fluids are injected into the well section between the two packers. However, the system has proven ineffective due to near-wellbore stress distribution causing fractures to jump past the packers and communicate to other sectors of the wellbore. Furthermore, static diversion techniques have proven ineffective, impractical, and uneconomical. Additionally, in long horizontal wells (as long as 6000 ft) straddle packers are not typically utilized.

Hydrajet fracturing is another commonly utilized industry technique. The hydrajet fracturing technique, based on a Bernoulli equation, maintains low wellbore pressure and initiates strategically placed fractures. While pumping fracturing fluids through the jets, the operator uses flow down the annulus to control bottom hole pressure and to supplement the proper fracture with fluid. Because the well becomes supercharged during fracturing, operators must use tools to maintain annulus pressure during pipe movement and install a tubing value in the tubing string downhole to allow new connections to be made in the tubing. Each fracture can be formulated with different fluids such as sand slurries or acid, depending on the rock formation surrounding the fracture entry point. Moreover, numerous small fractures can be placed through the well, bypassing damaged areas.

While the described methods assist in producing fractures, it is problematic and difficult to selectively choose the desired location and propagation of the fracture in horizontal open hole wells due to long horizontal wells (as long as 6000 ft) with varying stresses and lithology along the wellbore. Thus, the goal of the present invention is to provide a method for selective placement, initiation and propagation of a hydraulically induced fracture.

SUMMARY OF THE INVENTION

In one embodiment of the present invention, a method of selectively fracturing an underground formation traversed by a borehole, the method comprises: inserting a suspended packer assembly into the borehole; setting the packer assembly in the borehole at a predetermined location so as to position the packer assembly adjacent to the underground formation to be fractured by selectively anchoring said packer assembly so as to isolate a predetermined interval within the borehole by sealing an annulus in the borehole; compressing the packer assembly so as to further contact the underground formation and exert stress thereon; increasing the pressure on the packer assembly until fracture is initiated in the underground formation at the predetermined location; and further fracturing the underground formation to a desired propagation.

In another embodiment of the present invention, a method of selectively fracturing an underground formation traversed by a borehole comprising providing an apparatus having: an inner tubing string; a packer body carried on the inner tubing string; an upper packer element disposed around the inner tubing string included in the packer body; a lower packer element disposed around the inner tubing string included in the packer body, wherein the upper and lower packer elements are spaced apart; packer sealing means and anchoring means included in the packer body; a setting means for moving the upper packer element and the lower packer element toward each other for setting the packer sealing means and the anchoring means respectively for sealing and gripping engagement with the borehole; and locking means for locking the packer in place.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variation can be made in the present invention without departing from the scope or spirit of the invention. For instances, features illustrated or described as part of one embodiment can be used on another embodiment to yield a still further embodiment. Thus, it is intended that the present invention cover such modifications and variations that come within the scope of the appended claims and their equivalents.

Figure 1:
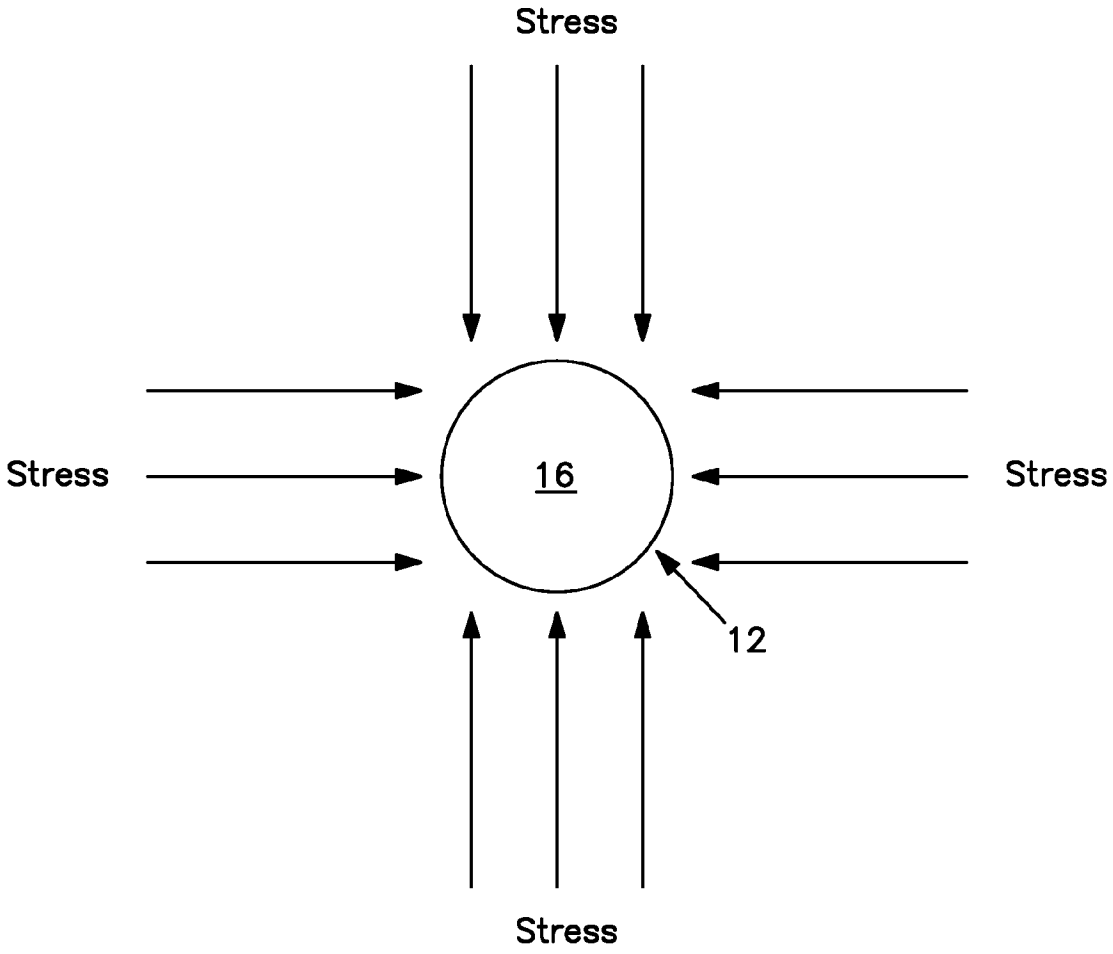
FIG. 1 is the stress concentration for a circular hole in a biaxial stress field.

Referring to FIG. 1, when a well is drilled, the stress carried by the rocks removed by the drilling process is transferred to the adjacent rock. The transferred stress results in the creation of a "stress cage" 16. A "stress cage" is a compacted area inherently formed around the wellbore by the drilling of the wellbore itself. An object is strongest when force is evenly distributed over its area, so as a reduction in area, e.g., caused by a crack, results in localized increase in stress. A material can fail, via a propagating crack, when a concentrated stress exceeds the materials theoretical cohesive strength. Referring to FIG. 1, stress cage 16 created in the wellbore has an evenly exerted stress concentration.

Figure 2:
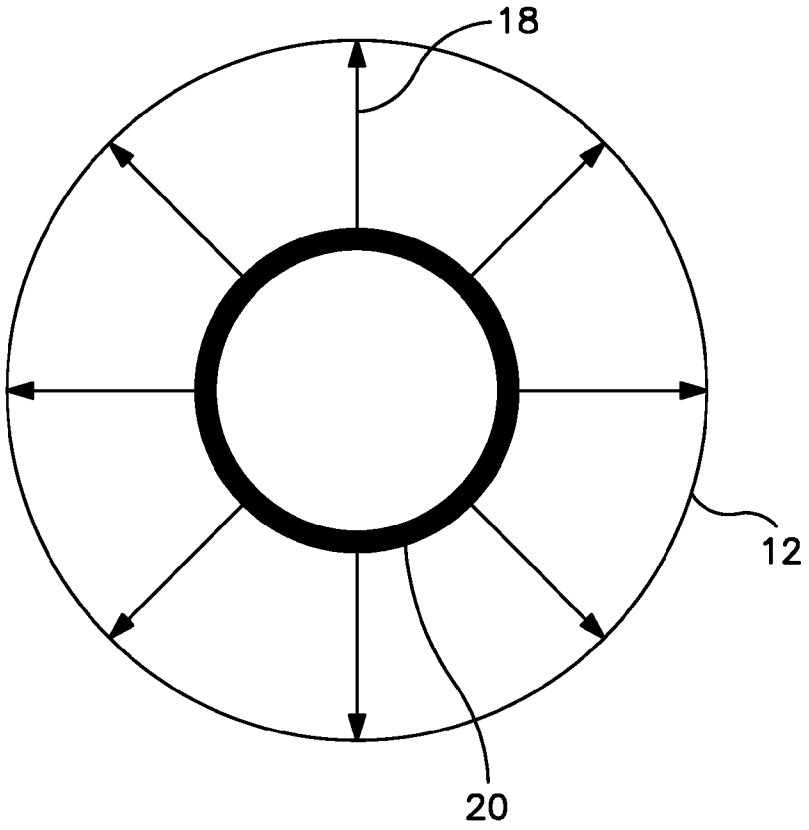
FIG. 2 is a cross-sectional view of the stress concentration for a circular hole in a biaxial stress field with a packer set.

By setting a packer assembly 20 in an open hole, the stress cage can be counteracted by the setting pressure 18 of the packer assembly, as shown in FIG. 2. Packer assembly 20 is of a solid body-type with at least one extrudable packing element, for example, formed of rubber. Solid body packers include multiple, spaced apart packing elements on a single packer. These multiple spaced apart packing elements are particularly useful especially for example in open hole (unlined wellbore) operations. In an embodiment, the packers are inflatable packers. In another embodiment, the packers are swellable packers.

Figure 3:
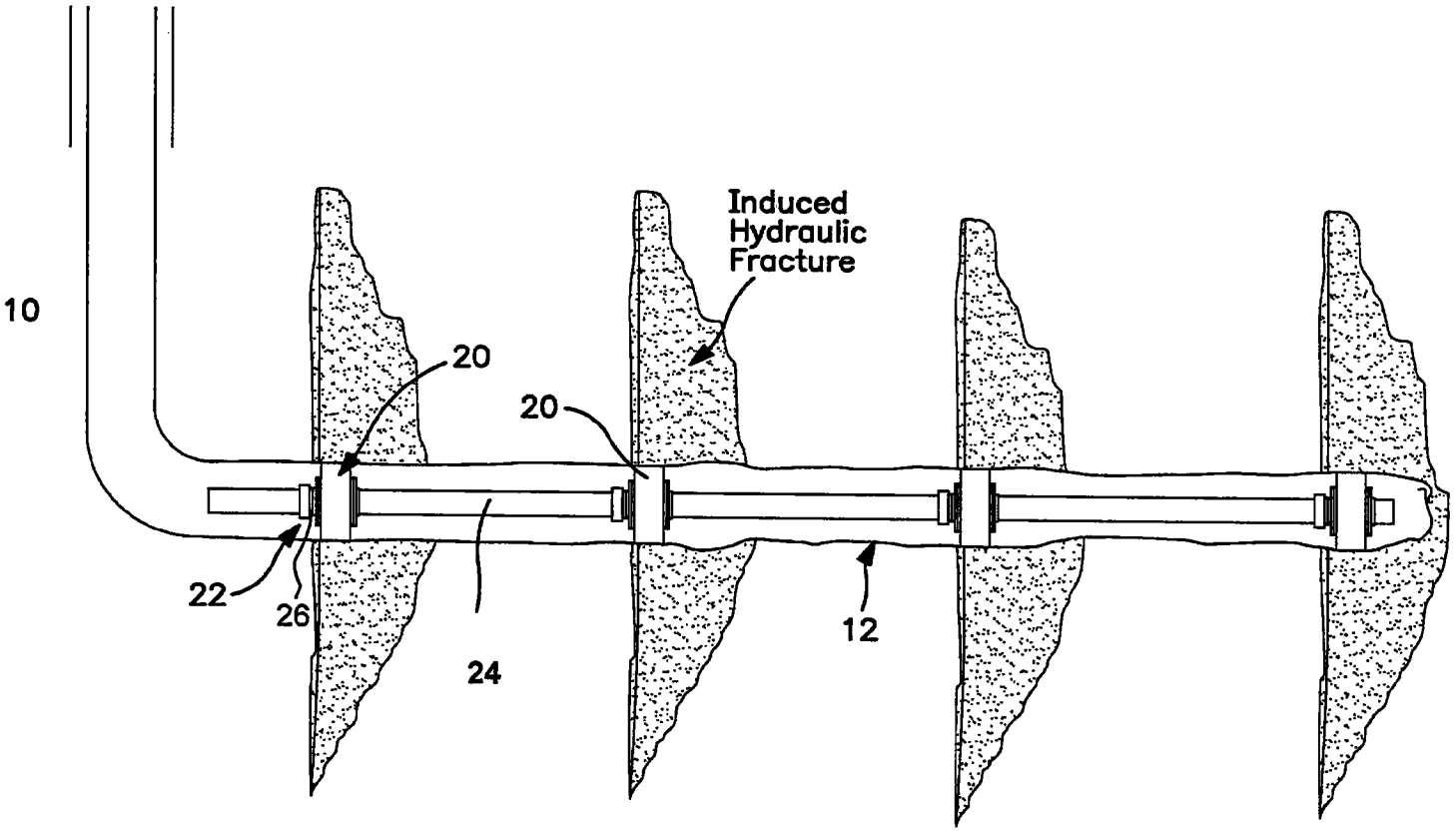
FIG. 3 is a longitudinal view of a wellbore containing multiple packer systems with ball activated sliding sleeves with induced propped fracture treatments.

Referring to FIG. 3, wellbore 12 is drilled within the earth's crust through a hydrocarbon producing formation 10. A wellbore assembly as shown can be used to stimulate the hydrocarbon producing formation in an effort to increase or restore the rate in which fluids can be produced from the surrounding wellbore. The wellbore assembly includes an inner tubing string 18. Packer 20 is mounted to tubing string 18 in various intervals. The packers are disposed about the inner tubing string and selected to seal the annulus between the inner tubing string and the wellbore wall, when the assembly is disposed in the wellbore. The packers divide the wellbore into isolated segments wherein fluid can be applied to one segment of the well, but is prevented from passing through the annulus into adjacent segments. As will be appreciated the packers can be spaced in any way relative to the intervals to achieve a desired interval length or number of intervals per segment.

Sliding sleeves 22 are disposed in inner tubing string 18 to control the opening and closing of ports 26. In this embodiment, a sliding sleeve is mounted over each ported interval to close them against fluid flow therethrough, but can be moved away from their positions covering the ports 26 to open the ports and allow fluid flow therethrough. The sliding sleeve includes a ball setting mechanism or another sealing mechanism to set the sliding sleeve in place. In one embodiment, the sliding sleeves 22 are each actuated by a device, such as a ball or plug, which can be conveyed by gravity or fluid flow through inner tubing string 18. The device engages against the sleeve, in this case the ball engages against sleeve 22, and when pressure is applied through inner tubing string 18 from the surface, the ball seats against and creates a pressure differential above and below the sleeves. Alternately, the sliding sleeve can be hydraulically actuated, including a fluid actuated piston secured by shear pins, so that the sleeve can be opened remotely without the need to land a ball or plug therein.

The assembly is run in and positioned downhole with the sliding sleeves each in their closed port position. The sleeves are moved to their open position when the tubing string is ready for use in the wellbore. Preferably, the sleeves for each isolated interval between adjacent packers are opened individually to permit fluid flow to one wellbore segment at a time, in a staggered, concentrated treatment process.

In use, the wellbore assembly, as described with respect to FIG. 3, can be used for inducing fractures in the wellbore. For selectively fracturing formation 10 through wellbore 12, the above-described assembly is run into the borehole and the packers are set to seal the annulus at each location creating a plurality of isolated annulus zone.

When the well is drilled the stress is carried by the rock that is removed by the drilling process is transferred to the adjacent rock, resulting in a "stress cage" around the wellbore. By setting the packer assembly in the open hole the stress cage can be counteracted by the setting pressure of the packer system. By selectively placing the packer assembly in a desired location and in conjunction with a sliding sleeve a fracture can be induced to initiate at the interface between the packer wall and the open hole.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. A method of selectively fracturing an underground formation traversed by a borehole, the method comprising:

a. inserting a suspended packer assembly into the borehole and setting the packer assembly in an open hole of the borehole;

b. setting the packer assembly in the borehole at a predetermined location so as to position the packer assembly adjacent to the underground formation to be fractured by selectively anchoring said packer assembly so as to counteract stress cages and to isolate a predetermined interval within the borehole by sealing an annulus in the borehole; and c. introducing a fluid to the packer assembly to increase the pressure on the packer assembly until a fracture is initiated adjacent to said packer assembly at said predetermined location, thus inducing a hydraulic fracture at an interface between the packer assembly and the open hole.

2. The method according to claim 1, wherein the underground formation to be fractured resides in a section of uncased hole.

3. The method according to claim 1, wherein the packer assembly is an inflatable packer.

4. The method according to claim 3, wherein the inflatable packer is inflated with a fracturing fluid.

5. The method according to claim 3, wherein the inflatable packer is inflated with cement.

6. The method according to claim 3, wherein after initiation of the fracture in the underground formation, decreasing the pressure of the fracturing fluid in the inflatable packer for further fracturing.

7. The method according to claim 6, wherein the further fracturing includes a step of removing fracturing fluid from the interval as soon as fracture propagation is observed.

8. The method according to claim 1, wherein the packer assembly is a swellable packer.

9. The method according to claim 1, wherein the packer assembly is set by a hydraulic actuation mechanism.

10. The method according to claim 1, wherein the packer assembly is set by a sliding sleeve mechanism.

* * * * *